US009452336B2

(12) United States Patent
Nelson et al.

(10) Patent No.: US 9,452,336 B2
(45) Date of Patent: Sep. 27, 2016

(54) MESH BASEBALL TEE

(71) Applicant: TRIAD SPORTS, INC., Camarillo, CA (US)

(72) Inventors: Dave Nelson, Camarillo, CA (US); John Lucas, Camarillo, CA (US)

(73) Assignee: TRIAD SPORTS, INC., Camarillo, CA (US)

( * ) Notice: Subject to any disclaimer, the term of this patent is extended or adjusted under 35 U.S.C. 154(b) by 0 days.

(21) Appl. No.: 14/301,167

(22) Filed: Jun. 10, 2014

(65) Prior Publication Data

US 2014/0364255 A1 Dec. 11, 2014

Related U.S. Application Data

(60) Provisional application No. 61/833,730, filed on Jun. 11, 2013.

(51) Int. Cl.
*A63B 69/00* (2006.01)

(52) U.S. Cl.
CPC ..... *A63B 69/0075* (2013.01); *A63B 69/0002* (2013.01); *A63B 2069/0008* (2013.01); *A63B 2102/02* (2015.10); *A63B 2102/182* (2015.10); *A63B 2102/20* (2015.10); *A63B 2210/50* (2013.01); *A63B 2225/093* (2013.01)

(58) Field of Classification Search
CPC ..... A63B 69/0075; A63B 69/0002; A63B 2069/0008; A63B 2243/0004
USPC ..... 473/417, 422, 451, 453
See application file for complete search history.

(56) References Cited

U.S. PATENT DOCUMENTS

| | | | | |
|---|---|---|---|---|
| 6,358,163 | B1 * | 3/2002 | Tanner | 473/417 |
| 6,682,445 | B1 * | 1/2004 | Tanner | 473/417 |
| 2003/0036446 | A1 * | 2/2003 | Udwin et al. | 473/417 |
| 2004/0138011 | A1 * | 7/2004 | Lin | 473/417 |
| 2004/0185968 | A1 * | 9/2004 | Livingstone | 473/417 |
| 2005/0266936 | A1 * | 12/2005 | Gutierrez | A63B 69/0002 473/417 |
| 2006/0019773 | A1 * | 1/2006 | Newman | 473/417 |
| 2006/0205540 | A1 * | 9/2006 | Liu | A63B 9/0002 473/417 |
| 2007/0105662 | A1 * | 5/2007 | Tanner | 473/417 |
| 2008/0139343 | A1 * | 6/2008 | Sandman | A63B 63/08 473/478 |
| 2012/0172153 | A1 * | 7/2012 | Newman | 473/417 |
| 2014/0295999 | A1 * | 10/2014 | Robinson | 473/417 |
| 2014/0364255 | A1 * | 12/2014 | Nelson | A63B 69/0075 473/417 |

* cited by examiner

*Primary Examiner* — Mitra Aryanpour
(74) *Attorney, Agent, or Firm* — Koppel, Patrick, Heybl & Philpott

(57) ABSTRACT

A tee for supporting a baseball comprising a longitudinal shaft comprising a first end and a second end, a base structure coupled to said first end and configured to rest on a surface, a mesh support connected to said second end of said shaft. The tee further comprising a coupler adapted to rigidly affix said mesh support to said second end of said shaft, wherein said shaft is adapted to change the distance of said mesh support above said surface.

14 Claims, 2 Drawing Sheets

MESH BASEBALL TEE

RELATED APPLICATION

This application claims the benefit of priority of U.S. Provisional Application Ser. No. 61/833,730, filed on Jun. 11, 2013. The contents of Ser. No. 61/833,730 including its drawings, schematics, diagrams and written description, are hereby incorporated in their entirety by reference.

BACKGROUND OF THE INVENTION

1. Field of the Invention

Embodiments of the invention relate generally to baseball tees, and more particularly, to baseball tees having a mesh support to support a baseball.

2. Description of the Related Art

Baseball tees are typically used in the process of teaching young children to hit a ball with a bat, by experienced players wanting to practice hitting balls off a tee, and in T-ball games. The typical baseball tee comprises a flat base plate placed on the ground, most often in the shape of a baseball home plate, which supports an adjustable vertical pole having a ball support cup on the upper end. A baseball is placed on the support cup so a youngster or experienced players can try to hit the stationary ball by swinging a bat instead of the more difficult task of attempting to hit a moving ball. With limited experience or limited coordination, youngsters may occasionally strike the cup or pole holding the ball, rather than the ball itself. This can be expected as part of the learning process. As a result, however, the tee is frequently tipped over or moved and has to be repositioned for the training session to continue. This can be a source of frustration and discouragement, as well as a safety concern, for the youngster and coach in the event of inadvertent contact with errant bat swings.

Tees hold the baseball at a given position which allows the batter to practice their swing without the necessity of a person pitching or a pitching machine throwing balls at the batter. Tees also allow the batter to position the ball at a given height above the ground and a given distance from the batter, such that the batter can practice hitting a ball in different hitting zones.

Conventional tees are made of hard durable materials, such as rubber or plastic, that can withstand the force of a bat hitting the tee. A consequence of using hard durable materials is that the conventional tee can be heavy and not easily transportable. Furthermore, the weight of the conventional tee increases the costs associated with manufacturing and distributing the conventional tee.

Thus, what is needed is a baseball tee that is easily transportable, while being resilient to withstand the typical striking forces from batters hitting the tee during normal use.

SUMMARY

A tee for supporting a baseball having a mesh support to support a baseball is presented which overcomes the problems noted above. In one embodiment, the tee comprising a longitudinal shaft comprising a first end and a second end, a base structure coupled to said first end and the base structure configured to rest on a surface, a mesh support connected to said second end of said shaft. The tee further comprising a coupler adapted to rigidly affix said mesh support to said second end of said shaft, wherein said shaft is adapted to change the distance of said mesh support above said surface.

In another embodiment, the tee comprises a longitudinal shaft comprising at least a lower portion and an upper portion, wherein the upper portion is slideably coupled to the lower portion, a base structure connected to the lower portion, a mesh support coupled to the upper section, wherein the mesh support extends upward from the longitudinal shaft. The tee further comprises a coupled adapted to rigidly affix the mesh support to the upper section, wherein a top portion of the mesh support is alterable by slideably adjusting the upper portion of the shaft.

These and other features, aspects and advantages of the invention will become better understood with reference to the following description and claims.

DETAILED DESCRIPTION

Figure 1:
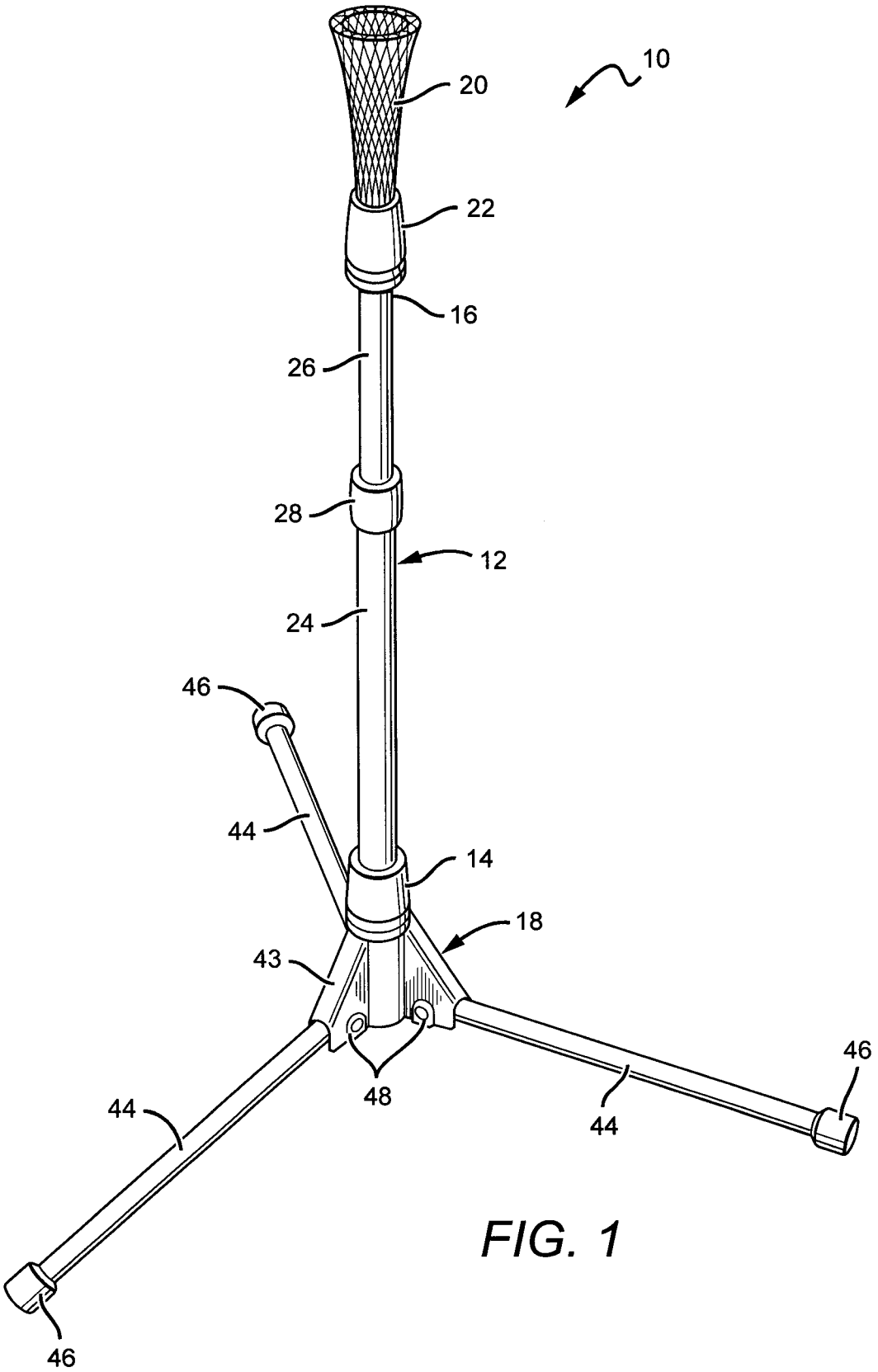
FIG. 1 is a perspective view of a tee according to an embodiment of the invention.

Embodiments of the invention provide a tee for supporting a baseball, wherein a mesh support is arranged to receive a baseball. The tee according to the invention can be arranged in many different ways with many different components, and is generally arranged to provide an easily transportable tee, while being resilient to withstand the typical striking forces from batters hitting baseballs off the tee during normal use.

Baseball tees are generally known in the art and are used when playing a T-ball game or when doing baseball related activities, such as practice or training sessions. Typical baseball tees can be made of hard plastic, rubber, wood, metals, and the like. Typical baseball tees have a surface to support a baseball to allow a batter to hit the ball off the tee. However, typical baseball tees are made of hard materials that can withstand the force of an errant swing so that the tee does not break due to the errant swing. Other typical baseball tees are arranged to allow the hard material to flex in response to an errant swing in order to absorb the striking force of the errant swing. In these typical baseball tees, the baseball is resting on a surface that is made of the hard material. If a batter hits the baseball along the lower half of the baseball, it is very likely that the batter will make contact with the tee and the baseball. This repeated hitting could damage the baseball tee and/or the bat used to hit the baseball on the baseball tee. Additionally, when the batter makes contact with the typical baseball tees made of hard materials, the hitting force can be transferred to the batter's hands, thereby causing a stinging sensation, which could result in injury.

Conventional baseball tees are rugged and made of hard materials that can withstand the striking force of the bat, but this results in the conventional baseball tees being bulky, heavy and not easily portable. Furthermore, conventional tees need to be disassembled in order to be transported and/or stored. Oftentimes, a component part of the conventional tee can go missing, thereby making the conventional tee unusable. In other instances, the conventional tee has a base that is large and takes up a lot of space, such that storing and/or transporting the tee is difficult. Also, manufacturers of conventional tees have an increase cost of manufacturing and shipping conventional tees because of the weight of the materials used to make the conventional tee, this cost is ultimately passed on to the end consumer.

The tee of the invention can provide a number of advantages beyond the conventional tee. For example, in some embodiments, a tee for supporting a baseball comprising a mesh support, wherein the mesh support is adapted to support a baseball. The mesh support receives the baseball and provides a support structure to properly hold the baseball, and provides minimal resistance to the swing of a bat. In other embodiments, the tee is light-weight and collapsible making the tee easily portable and takes up a reduced area when stored and/or not in use.

The invention is described herein with reference to certain embodiments but it is understood that the invention can be embodied in many different forms and should not be construed as limited to the embodiments set forth herein. In particular, the invention is described with reference to certain embodiments where the tee comprises a mesh support, but in other embodiments the configuration can be modified. The invention can also be used with different types of sports devices beyond baseballs and baseball bats, although the invention is described herein with reference to baseballs and baseball bats.

It is to be understood that when an element or component is referred to as being "on" another element or component, it can be directly on the other element or intervening elements may also be present. Furthermore, relative terms such as "between", "within", "adjacent", "below", "proximate" and similar terms, may be used herein to describe a relationship of one element or component to another. It is understood that these terms are intended to encompass different orientations of the device in addition to the orientation depicted in the figures.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual systems or fixtures embodying the invention can be arranged in many different ways with many more features and elements beyond what is shown in the figures.

Embodiments of the invention are described herein with reference to illustrations that are schematic illustrations. As such, the actual thickness of elements and features can be different, and variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. An element illustrated or described as square or rectangular will typically have rounded or curved features due to normal manufacturing tolerances. Thus, the elements illustrated in the figures are schematic in nature and their shapes are not intended to illustrate the precise shape of a feature of a device and are not intended to limit the scope of the invention.

Figure 2A:
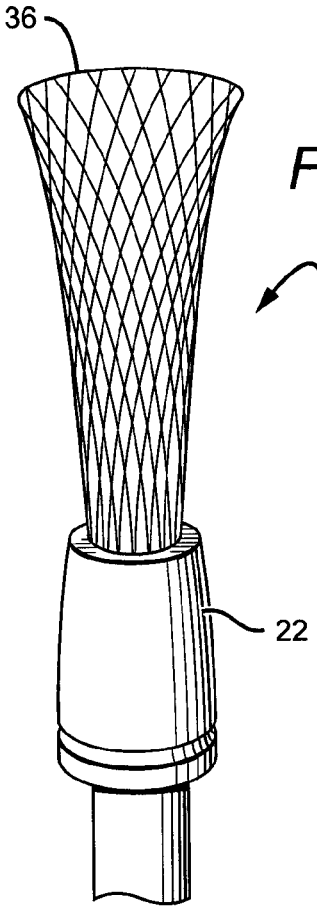
FIG. 2*a* is a perspective view of a mesh support of the tee of FIG. 1.
Figure 2B:
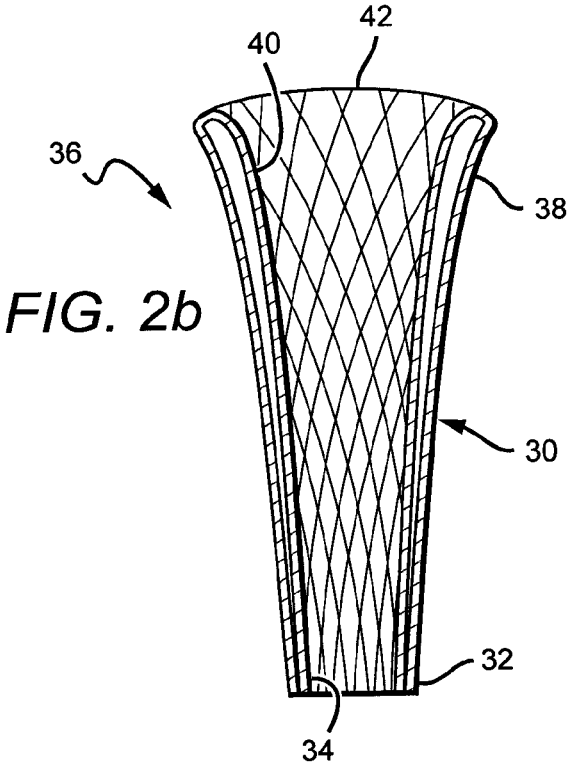
FIG. 2*b* is a cross-sectional view of the mesh support of the tee of FIG. 1.
Figure 3:
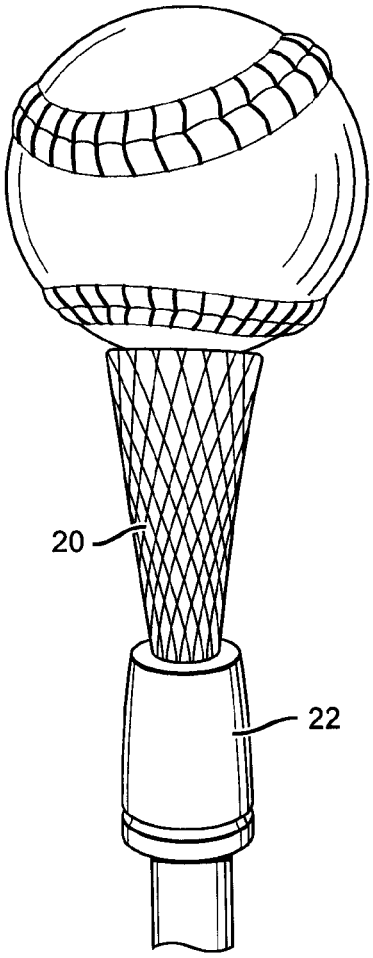
FIG. 3 is a perspective view of the tee according to an embodiment of the invention.

FIGS. 1-3 show an embodiment of a tee 10 for supporting a baseball according to the invention. The tee 10 comprising a longitudinal shaft 12 comprising a first end 14 and a second end 16, a base structure 18 coupled to the first end 14 of the longitudinal shaft 12 and configured to rest on a surface, a mesh support 20 connected to the second end 16 of the longitudinal shaft 12, and a coupler 22 adapted to rigidly affix the mesh support 20 to the second end 16 of the longitudinal shaft 12.

The embodiment shown in FIGS. 1-3 of a tee 10 is referenced in connection with supporting a baseball. The invention is not intended to be limited to supporting a baseball. As used herein, the term baseball can include other sporting balls, such as but not limited to a softball, Wiffle® ball, golf ball, cricket ball, tennis ball, racquetball and/or any ball that can be struck or hit with a bat, stick, club, racket or the like.

The longitudinal shaft 12 comprises a first end 14 and a second end 16 opposite the first end. The longitudinal shaft 12 is arranged to alter its length. Altering the length of the longitudinal shaft 12 is allowed due to the longitudinal shaft comprising a lower portion 24 and an upper portion 26. The lower portion 24 is arranged to receive the upper portion 26. The lower and upper portion 24, 26, in combination, provide an adjustable longitudinal shaft length, wherein the upper portion is adjustable coupled to the lower portion 24. In one embodiment, the lower portion 24 is substantially hollow, such that the upper portion 26 is arranged to be received within the lower portion 24. In other embodiments, the upper portion 26 is substantially hollow, such that the lower portion 24 is arranged to be received within the upper portion 26. In yet other embodiments, both the lower and upper portion 24, 26 can be hollow. The lower and upper portions 24, 26 can be arranged in many different ways and the invention is not intended to be limited to the embodiments disclosed herein. In other embodiments, the lower portion 24 has a smaller radius or size than the upper portion 26 allowing the lower portion to be received by the upper portion. While in other embodiments, the upper portion 26 has a smaller radius or size than the lower portion 24. In yet other embodiments, the lower and upper portions 24, 26 can have the same or dissimilar shape. The longitudinal shaft 12 can be made of many different rigid materials, such as but not limited to aluminum, wood, plastic, metals, composites, and the like, or a combination thereof.

The longitudinal shaft 12 further comprises a locking mechanism 28 adapted to adjust the length of the longitudinal shaft 12 and lock the upper portion 26 to a desired position. The locking mechanism 28 maintains the length of the longitudinal shaft 12 as set to a desired length. In some embodiments, the locking mechanism 28 can be arranged to exert a force on at least one of the lower portion 24 and/or upper portion 26 in order to maintain the length of the longitudinal shaft. In other embodiments, the locking mechanism 28 can be a locking tab or pin that is received within a respective one of a plurality of holes of the lower and upper portions 24, 26. The locking mechanism 28 can be configured in many different ways and is not intended to be limited to the embodiments disclosed herein. In other embodiments, the locking mechanism 28 can be a clamp, clasp, or arranged to threadedly receive at least one of the lower and upper portions 24, 26 to maintain the length of the longitudinal shaft 12 at a desired length.

The base structure 18 is coupled to the first end 14 of the longitudinal shaft 12 and is configured to rest on a surface. The base structure 18 is arranged to position the longitudinal shaft 12 substantially perpendicular to the surface. As shown in FIG. 1, the base structure 18 comprises a base coupler 43 and a plurality of base legs 44. The base coupler 43 is coupled to the first end of the longitudinal shaft 12. Each of the plurality of base legs 44 are coupled to the base coupler 43 and extend outward such that each of the plurality of base legs 44 contacts the surface to stabilize the tee. In some embodiments, each of the plurality of base legs 44 are longitudinal extensions comprising a base leg first end 46 and a base leg second end 48, wherein the base leg second end 48 is coupled to the base coupler 43. In some embodiments, the base leg second end 48 is pivotally coupled to the base coupler 43, such that each of the plurality of base legs 44 are pivotable towards the longitudinal shaft 12. An advantage of the invention is that the pivotable base legs 44 allows the tee to reduce its size to allow for ease of portability. Additionally, the invention does not require disassembly of component parts of the tee to store and/or reduce the space the tee takes up when not in use. This results in a smaller area taken up when the tee is not in use, whereas conventional tee have a wide base that limits and/or prevents the reduction of size of conventional tees for purposes of storing when not in use.

In some embodiments, the base legs 44 can pivot about the base leg second end 48 to its tee supporting position or towards the shaft 12, such that the base legs 44 are substantially adjacent the shaft 12, in its tee storage position. However, in other embodiments, the base legs 44 can be arranged to have a plurality of tee supporting positions, such that base legs 44 can change the distance of the mesh support above the surface. An advantage of the invention is that the base legs 44 can also be used to change the distance of the mesh support above the surface, in addition to or instead of the arrangement of the longitudinal shaft 12 discussed above. This allows for the tee to be used in many different ways of adjusting the distance the mesh support is above the surface, which can provide added adjustments for batters of various heights. In some embodiments, the tee 10 can be arranged such that each of the base legs 44 are substantially contacting the surface the tee 10 is on. In other embodiments, the base legs 44 can be positioned such that the tee 10 is slightly elevated from the surface. In this embodiment, each of the base legs 44 are arranged such that the base leg first ends 46 are contacting the surface and the base coupler 43 is slightly elevated from the surface. Typically, the base legs 44 will be positioned at the same arrangement so that the tee 10 is level with respect to the surface. However, an advantage of the invention is that the base legs 44 can be pivoted into different supporting positions and configured in different arrangements to compensate for unleveled surfaces, such that the tee 10 can be substantially level with respect to the unleveled surface.

The embodiment of FIG. 1 shows the tee 10 having three base legs 44. However, the invention is not intended to be limited to three base legs 44. In other embodiments, the tee 10 can have more or less than three base legs 44. In yet other embodiments, the tee can comprise a base structure that is a substantially flat plate that is perpendicular to the longitudinal shaft.

The mesh support 20 is connected to the second end 16 of the longitudinal shaft 12 and is adapted to support a baseball, as shown in FIG. 3. The mesh support 20 comprises a mesh tubing 30 comprising a first mesh end 32 and a second mesh end 34. The first and second mesh ends 32, 34 are coupled to the second end 16 of the longitudinal shaft 12. The coupler 22 couples the mesh support 20 to the second end 16 of the longitudinal shaft 12. The coupler 22 receives both the first and second mesh ends 32, 34 to rigidly affix the mesh support to the second end 16 of the longitudinal shaft 12. The coupler 22 ensures that the first and second mesh ends 32, 34 do not become detached from the coupler and/or the second end 16 of the shaft 12.

The mesh support 20 is arranged to provide a support structure 36 that is adapted to receive the baseball. The support structure 36 supports the weight of the baseball, such that the baseball is in a teed position. With reference to FIGS. 2*a* and 2*b*, the mesh tubing 30 is folded onto itself in order to form the support structure 36. The support structure 36 comprises a support surface 42, a first wall 38 and a second wall 40. The first and second walls 38, 40 are formed by folding the mesh tubing 30 onto itself, such that the first and second mesh ends 32, 34 are substantially aligned. The first and second mesh ends 32, 34 are received by the coupler 22 in order to connect the mesh support 20 to the shaft 12.

The mesh tubing 30 is flexible and has elastic properties, such that the mesh tubing 30 can be deformed by an application of force and return to its original shape when the application of force is removed. For example, when the baseball is received by the support structure 36, a batter can swing and hit the baseball off the tee 10, and the mesh support will be in its original shape afterwards and ready for another baseball to be placed on the tee. The batter may contact the mesh support 20 when hitting the baseball off the tee 10, which results in an application of force onto the mesh support 20. The mesh support 20 is deformed due to the force applied by the bat, but the mesh support 20 returns to its original shape after the force applied by the bat is removed. Additionally, the mesh support 20 does not impart a substantial force onto the bat during a swing, such that it is unlikely that a swing will result in the hitting force being transferred to the batter's hands, thereby eliminating or substantially preventing injury to the batter. The mesh support 20 can be made of many different materials, such as but not limited to plastic, nylon, vinyl, polyester, and the like, or a combination thereof. The flexible and elastic properties of the mesh support 20 allow the tee 10 to be more durable than conventional tees. Conventional tees are typically made of rubber or other hard materials and repeated hitting of baseballs off conventional tees will cause damage to conventional tees, and in such instances could cause conventional tees to break, tear, and/or rip, thereby making the conventional tee unusable.

An advantage of the invention is that a swing of the bat will not likely result in the tee 10 toppling over due to the force applied by the bat; as is the case in conventional tees. Instead, the mesh support 20 receives the force from the swinging bat and absorbs the force which momentarily deforms the mesh support 20, such that the tee 10 is still standing and is not toppled over or fallen on the ground due to the force of the swing of the bat. Additionally, the mesh support 20 does not substantially affect the bat speed during the swing of the bat. The mesh support 20 holds the baseball and does not provide notable resistance against the force of the bat striking the baseball on the tee 10, due at least in part to the elasticity of the mesh support. The mesh support 20 of the tee 10 does not affect the bat speed during the swing and/or alter the trajectory of the baseball off the tee. The tee 10 substantially mimics the sensation the batter could experience while hitting a baseball that is pitched toward the batter. Conventional tees can be made of hard materials, such that hitting a baseball off conventional tees could affect the bat during the swing of the bat, either reducing the bat speed and/or altering the swing path of the bat, either of which could alter the trajectory of the baseball off the tee.

The invention also allows a batter to practice their swing without a baseball being on the tee 10. For example, the batter can swing at the mesh support 20 where the baseball would be received. This allows a batter to practice hitting the location of where the baseball would be on the tee and not knocking the tee over. At least one way the batter can tell if they are making contact with the mesh support 20 of the tee 10 is because of the sound of the bat hitting the mesh support. Using a conventional tee, to practice a swing without a ball on the tee, would result in the batter hitting the conventional tee and likely knocking the tee over, or potentially injuring themselves, or causing damage to the conventional tee.

The mesh support 20, as coupled to the coupler 22, comprises a first wall 38 and a second wall 40. The first wall is an exterior surface of the mesh support 20, while the second wall 40 is an interior surface of the mesh support 20, such that the mesh support extends upwards from the shaft 12. The double walled mesh support 20 provides a sturdy support surface 42 that allows a baseball to be received and held by the mesh support 20. The support surface 42 is separated from the coupler 22 based on the length of the first and second walls 38, 40. The lengths of the first and second walls 38, 40 are substantially similar, and are arranged to separate the baseball on the support surface 42 a specified distance from the coupler 22, such that the bat is intended to only strike the baseball and/or the mesh support 20.

The tee 10 is arranged to change the distance of the mesh support above the surface upon which the tee is on. The top portion, or the support surface 42, of the mesh support 20 is alterable by adjusting the length of the shaft 12. In some embodiments, the length of the shaft 12 is slideably adjusted by slideably adjusting the upper portion 26 of the shaft 12. In other embodiments, the height of the support surface 42 above the surface can be adjusted by the base structure 18. As described above, the base legs 44 can be positioned in many different configurations that can alter the height of the support structure 42.

An advantage of the invention is that the tee 10 is light-weight and easily transportable. As discussed above, the base structure can be collapsed such that the base legs pivot towards the shaft, which reduced the shape and size of the tee making the tee easy to transport and store. Additionally, the shaft is arranged to minimize its length by adjusting the upper and lower portions of the shaft so that the length of the shaft can be minimized, thereby assisting in reducing the space the tee takes up while being transported or stored. The tee is resilient and can withstand the typical striking forces exerted upon it due to regular use of batters hitting baseballs off the tee. Yet another advantage of the invention is that the tee 10 is configured such that it is easy to setup and collapse the tee.

While particular embodiments of the invention have been shown and described, numerous variations and alternate embodiments will occur to those skilled in the art. Accordingly, it is intended that the invention be limited only in terms of the appended claims.

We claim:

1. A tee for supporting a baseball, comprising:

a longitudinal shaft adjustable in length, comprising a first end and a second end;

a base structure coupled to said first end of said longitudinal shaft, configured to rest on a surface, said base structure comprising a base coupler and a plurality of base legs coupled to said first end, each of said plurality of base legs extend outward from said first end, wherein at least a base leg end of each of said plurality of base legs contact said surface to stabilize said tee;

a mesh support connected to said second end of said longitudinal shaft, said mesh support comprising a mesh tubing, said mesh tubing folded to form a first wall, a second wall and a support surface, wherein said mesh support is adapted to support said baseball; and a coupler adapted to rigidly affix said mesh support to said second end of said longitudinal shaft, wherein said longitudinal shaft is adapted to change the distance of said mesh support above said surface.

2. The tee of claim 1, wherein said longitudinal shaft comprises at least a lower portion and an upper portion in combination providing an adjustable longitudinal shaft length adjustably coupled to said lower portion.

3. The tee of claim 2, wherein said longitudinal shaft comprises a locking mechanism adapted to adjust the length of said shaft and lock said upper portion to a desired position.

4. The tee of claim 1, wherein said mesh tubing comprising a first mesh end and a second mesh end, wherein said first and second mesh ends are coupled to said second end of said longitudinal shaft by said coupler.

5. The tee of claim 1, wherein said support surface is adapted to receive said baseball.

6. The tee of claim 1, wherein said longitudinal shaft is hollow.

7. The tee of claim 1, wherein said base structure is a substantially flat plate perpendicular to said shaft.

8. The tee of claim 1, wherein said plurality of base legs are pivotally coupled at said first end of said longitudinal shaft, wherein at least one of said plurality of base legs is adjustable to compensate for irregularities of said surface.

9. The tee of claim 8, wherein said plurality of base legs are pivotable towards said longitudinal shaft.

10. The tee of claim 8, wherein said plurality of base legs are adjustable to adjust the height of said mesh support.

11. The tee of claim 1, wherein each of said plurality of base legs are pivotally coupled to said base coupler such that each of said plurality of base legs can be pivoted into different supporting positions.

12. The tee of claim 11, wherein said different supporting positions allow at least one of said plurality of base legs to compensate for irregularities in said surface such that said longitudinal shaft is substantially perpendicular to said surface.

13. A tee for supporting a baseball, comprising:

a longitudinal shaft comprising at least a lower portion and an upper portion, wherein said upper portion is slidably coupled to said lower portion;

a base structure connected to said lower portion, said base structure comprising a plurality of base legs that extend out from said lower portion;

a mesh support coupled to said upper portion, wherein said mesh support extends upward from said longitudinal shaft, said mesh support comprising a mesh tubing, said mesh tubing folded to form a first wall, a second wall and a support surface, wherein said mesh support is adapted to support said baseball; and a coupler adapted to rigidly affix said mesh support to said upper portion, wherein a top portion of said mesh support is alterable by slidably adjusting said upper portion of said longitudinal shaft.

14. The tee of claim 13, wherein said mesh support is configured to receive a baseball or a softball.

* * * * *